United States Patent [19]

Boldt

[11] Patent Number: 4,580,640

[45] Date of Patent: Apr. 8, 1986

[54] STROKE CONTROL RESPONSIVE TO IMPACT OF HYDRAULIC HAMMER

[75] Inventor: Robert R. Boldt, Taylor Ridge, Ill.

[73] Assignee: East Moline Metal Products Company, East Moline, Ill.

[21] Appl. No.: 718,461

[22] Filed: Apr. 1, 1985

[51] Int. Cl.[4] ..... E21B 5/00

[52] U.S. Cl. ..... 173/10; 173/82; 254/276

[58] Field of Search ..... 173/4.5, 10, 11, 14, 173/81, 82, 85, 86; 254/276; 405/228

[56] References Cited

U.S. PATENT DOCUMENTS

| | | | |
|---|---|---|---|
| 2,660,404 | 11/1953 | Meier | 173/82 |
| 2,742,267 | 4/1956 | Meier | 173/10 |
| 3,938,595 | 2/1976 | Swenson | 173/1 |
| 4,058,175 | 11/1977 | Holland | 173/1 |

FOREIGN PATENT DOCUMENTS

| | | | |
|---|---|---|---|
| 2069146 | 8/1981 | United Kingdom | 173/10 |

*Primary Examiner*—Frank T. Yost

*Assistant Examiner*—Hien H. Phan

*Attorney, Agent, or Firm*—Glenn H. Antrim

[57] ABSTRACT

A pickup is connected to a system of sheaves of a mobile hydraulic hammer for providing a signal proportional to velocity of a hammer weight. The pickup is connected to the input of a differentiating circuit, and the output of the differentiating circuit is connected to the starting input of an electronic timer. Two-level output of the timer is connected to hydraulic valves that control the lifting and dropping of a hammer weight. The signal applied to the starting input of the timer has two states, one state resulting from any noticeable acceleration of the hammer weight and the other state resulting from zero acceleration. The timer starts in response to zero acceleration at the time of impact of the hammer weight and provides a signal to cause the hammer weight to be lifted without delay to a predetermined height according to a predetermined timing period, the height always being with reference to the level at which impact occurred. At the end of the timing period, the timer provides the other one of two signals to cause the hammer weight to drop.

4 Claims, 5 Drawing Figures

STROKE CONTROL RESPONSIVE TO IMPACT OF HYDRAULIC HAMMER

BACKGROUND OF THE INVENTION

This invention relates to electronic and hydraulic controls for determining the length of strokes of weights in hydraulic hammers, and particularly to controls for sensing different impact levels of weights for initiating uniform length of strokes above various impact levels.

The stroke control of this invention is particularly applicable to mobile hydraulic hammers similar to the one described in U.S. Pat. No. 3,384,186 issued on May 21, 1968 to D. E. Broderson et al for Mobile Hydraulic Hammer. These hammers raise heavy weights to controlled heights by operation of hydraulic cylinders and then let the weights fall on materials to be either impacted or broken. In a typical mobile hydraulic hammer, the weight is raised by a hydraulic cylinder; the expansion of the cylinder is controlled by operation of one or more hydraulic valves; and the operations of the valves are controlled by solenoids that are operated by electrical or electronic control circuits. The present invention is directed to improvement of the electronic control circuits.

As in U.S. Pat. No. 3,384,186 to which reference has been made above, the control circuit includes a timing circuit for determining the length of time that a hydraulic cylinder fills to determine the height of a hammer weight. In this particular reference, operation of one manual control determines the time for pumping fluid into the hydraulic cylinder, and operation of another control determines the period between the dropping of the hammer weight and the starting of a successive lift. When surface that is being compacted or broken is quite level, these controls can be set to provide a desired height to which the hammer weight is lifted and to determine that the lifting period will be started immediately upon impact. Controls on other equipment may sense a particular level through which a hammer passes to determine the starting of a succeeding stroke. Such a control is described in U.S. Pat. No. 3,938,595 issued to William J. Swenson on Feb. 17, 1976 for Apparatus and Method for Driving Bulb Piles.

In practice, mobile hydraulic hammers are often used to compact earth where the lowest level to which a hammer travels varies substantially. Manual controls that determine intervals of operation and do not compensate automatically for different levels of impacts must be adjusted constantly in an effort to approach the desired length of stroke and the maximum rate of operation, the maximum rate being achieved when each succeeding stroke is started immediately after impact. Manual adjustment of these controls is tedious, and even skilled operation of the controls cannot always provide either the desired length of stroke or the maximum rate of operation.

SUMMARY OF THE INVENTION

According to the present invention, a sensor is coupled to a sheave of a hydraulically controlled lifting system for determining acceleration of a hammer weight. The sensing of zero acceleration resulting from the hammer weight hitting material starts a timer for determining a predetermined interval according to adjustment of the timer. During the predetermined interval, a cylinder of a hydraulic system is extended to lift the hammer weight to a predetermined height. At the end of the timing interval, the timer dumps the cylinder to let the hammer weight drop. The sensor provides a necessary change in control signal in response to impact of the hammer weight to restart the timer, the timer again providing, without delay, control to the hydraulic system as required to lift the hammer weight.

Various sensors for determining acceleration can be used. A preferred sensor described herein is an electromagnetic device or proximity pickup coupled to a sheave at the upper end of a tower or lead of the structure supporting the hammer weight. The timer in a conventional manner controls transistor switches that in turn control solenoids connected to hydraulic valves.

The pickup or accelerative sensor used in a preferred embodiment develops pulses having a frequency determined by the rate of rotation of the sheave, and the pulses are differentiated in accelerative signal circuits. When the sheave is being accelerated any noticeable amount, change in rate of the pulses upon being differentiated saturate output circuits to provide a signal of a first state to the timer to prevent start of timing. When the pulses occur at a constant frequency during constant acceleration, the output circuits of the accelerative signal circuits become unsaturated to provide a second state to the timer to start timing. Therefore, the desired control described above is obtained. During timing, the timer provides voltage at a first state to a transistor switch for filling the cylinder for lifting the hammer, and during the period when the timer is inoperative, the timer provides a second state of voltage to a transistor switch for dumping the cylinder as required to permit the hammer weight to drop.

DESCRIPTION OF THE PREFERRED EMBODIMENT

Figure 1:
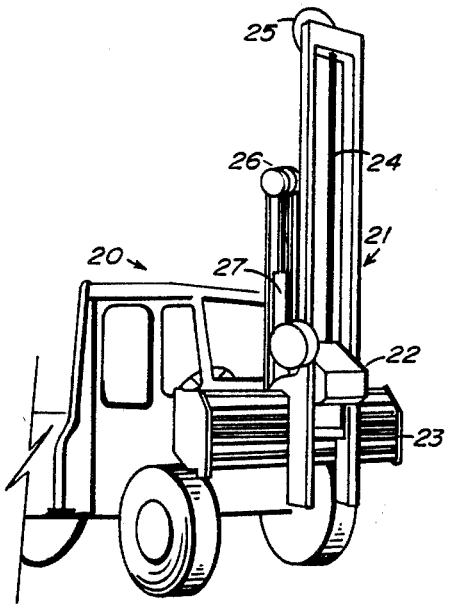
FIG. 1 is a fragmentary, front oblique view of a mobile hydraulic hammer in which the stroke control of this invention is incorporated.

A typical machine to which the present stroke control may be applied is partly shown in FIG. 1. A tower or lead 21 for supporting a hammer weight 22 is supported on a transverse rail assembly 23 attached to the front end of a vehicle 20. The lead 21 usually comprises a pair of spaced vertical members for guiding a hammer weight 22 therebetween, and the weight is supported by an intermediate vertical cable 24. The cable 24 runs over a central sheave 25 at the top of the lead 21 and then continues downward to a system of sheaves 26. The system of sheaves 26 comprises two blocks of a plurality of sheaves, the blocks being separated vertically and being connected by a central, vertical hydraulic cylinder 27. The cylinder 27 is extended to increase separation between the blocks of the system 26 for lifting the weight 22 to a desired height, and then the cylinder 27 is quickly dumped to let the system of sheaves 26 contract and let the hammer weight 22 accelerate downward almost at the rate of a free falling body. A typical example of the construction of mobile hydraulic hammers is described more fully in U.S. patent application No. 3,384,186 referred to above.

Figure 2:
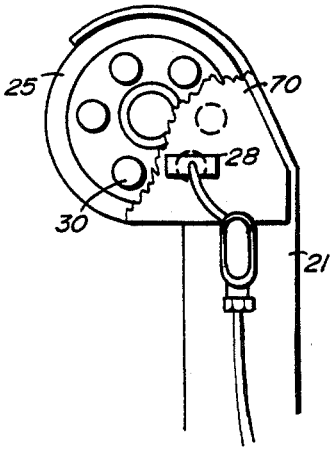
FIG. 2 is a side view of a tower or lead of FIG. 1 to show location with respect to an upper sheave of a magnetic pickup used as an accelerative sensor.
Figure 4:
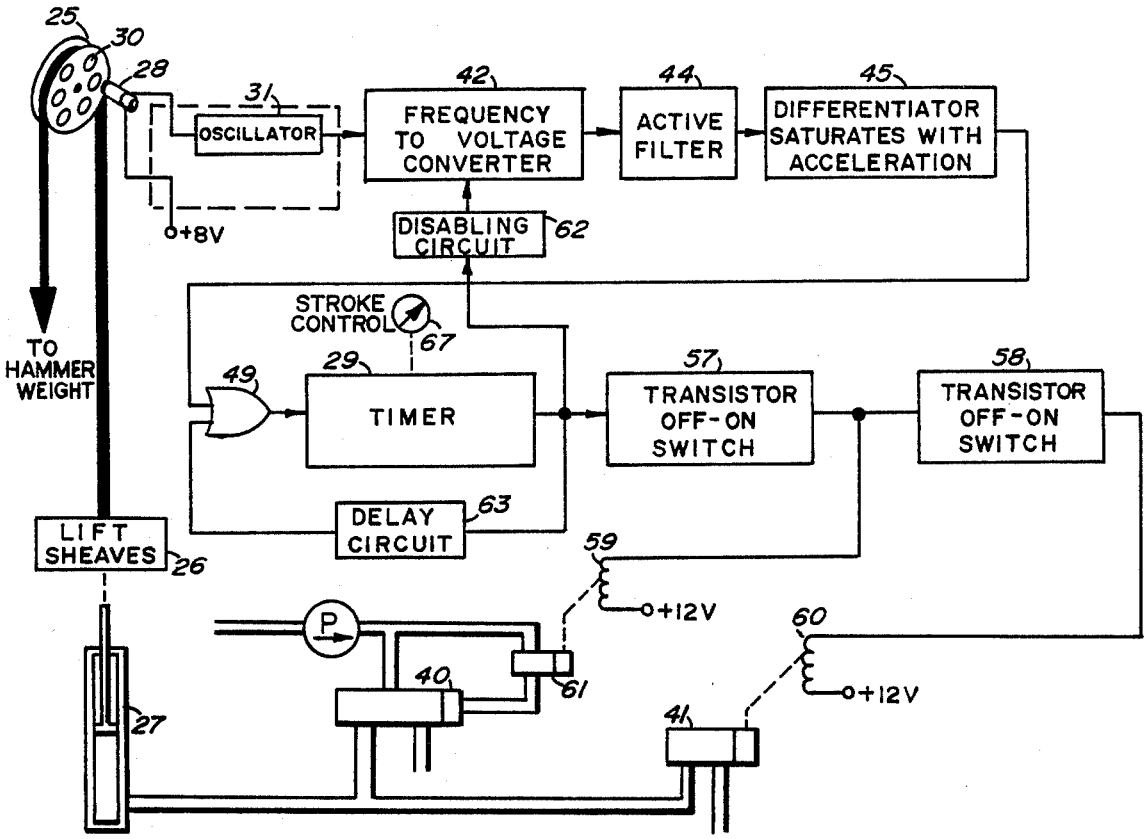
FIG. 4 is a block diagram of the control of this invention shown interconnected with a fragmentary diagram of a hydraulic system for a hammer.

A proximity pickup 28 of FIG. 2 and electronic circuits of FIG. 4 function as an accelerometer to control an adjustable timer 29. The placement of a pickup 28 as shown in FIG. 2 keeps the pickup from dirt and flying debris and provides a position for easy connection to the pickup. In place of a proximity pickup 28 to develop pulses, various other pickups such as electrical contacts associated with the sheave 25 or light sensing devices might be used. For simplicity and reliability, a commercial proximity pickup 28 comprising an inductive coil has been selected. The pickup 28 is secured proximate a sheave 25 to the side of a cover 70 such that the inductive sensing element of the pickup 28 is opposite either iron spokes or circumferentially spaced holes between the hub and the rim of the sheave 25. As the sheave 25 is rotated, the permeability of the pickup 28 is changed abruptly for developing a series of pulses. In the available proximity pickup, the resulting abrupt variations in inductance interrupts the operation of an oscillator 31 of FIG. 4.

Figure 3:
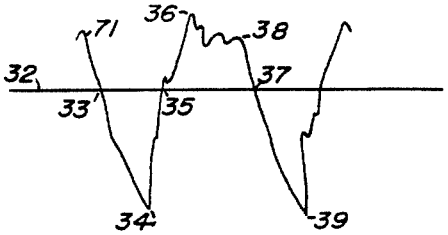
FIG. 3 is a curve showing velocity of a hammer weight with respect to time when successive strokes of the hammer weight are controlled automatically by a control of this invention.

The proximity pickup 28 that is being used as an accelerative sensor does not function as a true accelerometer in that it provides only absolute values and also in combination with its electronic circuit has a tendency to provide the same output for zero velocity as for zero acceleration. Reference to FIG. 3 showing a velocity curve of the hammer weight 22 as plotted against time is helpful to understand: the requirement for disabling circuits as described below to avoid the ambiguity in acceleration as provided by the proximity pickup 28, the lifting of the hammer weight automatically after impact, and automatic adjustment of the length of stroke for successive different levels of impact of the hammer weight 22.

Zero velocity of the hammer weight 22 occurs when the curve crosses the horizontal line 32. Tracing the curve downward from a starting point 33 where the velocity curve intersects the line 32, the cylinder 27 of FIG. 1 has been dumped under control of the timer 29 of FIG. 4 to allow the hammer weight 22 to fall at a rate of acceleration a little less than the acceleration of a free body, as shown by the negative slope of the curve, to the point 34 at the time when the hammer weight 22 hits material. From the lowest point 34 of the velocity curve, the curve has a steep, positive slope upward to intersect the line 32 at point 35, the time at which the hammer weight 22 has been stopped at its lowest point of travel. At point 34, the sheave 25 momentarily has zero acceleration, and this zero acceleration provides voltage for starting timing by the timer 29. As described in more detail below, the starting of the timer 29 results in changing the positions of hydraulic valves to start filling the hydraulic cylinder 27 immediately. Therefore, as soon as the hammer weight 22 is stopped as represented by the point 35, the hammer weight 22 continues to be accelerated upward as shown by positive slope between the point 35 and the point 36 at the peak of the velocity curve. The acceleration of the hammer weight 22 is momentarily decreased but continues in the same direction to raise the hammer weight 22 until after the velocity curve has turned downward and intersects the zero line 32 at point 37. At the peak 36, the hammer weight 22 has reached maximum velocity and as shown by the dip in the top portion of the curve decelerates momentarily only because of the characteristic of a governor (not shown) controlling the speed of an engine connected to a pump for supplying hydraulic fluid to the piston 27. At the subsequent point 38, the timer 29 has reached the end of its timing interval and changes operation of the hydraulic valve to dump the cylinder 27. Due to inertia, the hammer weight 22 continues upward for a short distance while it is decelerating at approximately the rate of acceleration of gravity. The point 37 corresponds to the point 33 described above at which the hammer weight 22 starts accelerating downward.

During the timing period between the points 34 and 38, the application of starting voltage to the timer 29 would not be effective, and anyway, control circuits are disabled to prevent development of starting voltages. At point 38 on the velocity curve, the timer 29 has reached the end of its timing interval and therefore, could be started again erroneously by the sensing of ambiguous zero acceleration before the lowest point 39 is reached. To prevent such premature signal, a delay circuit as described subsequently is provided around the timer 29 to prevent starting of the timer until the hammer weight 22 has reached a point at least somewhat below the zero line 32 at which time the downward acceleration of the hammer weight 22 is positively established.

Figure 5:
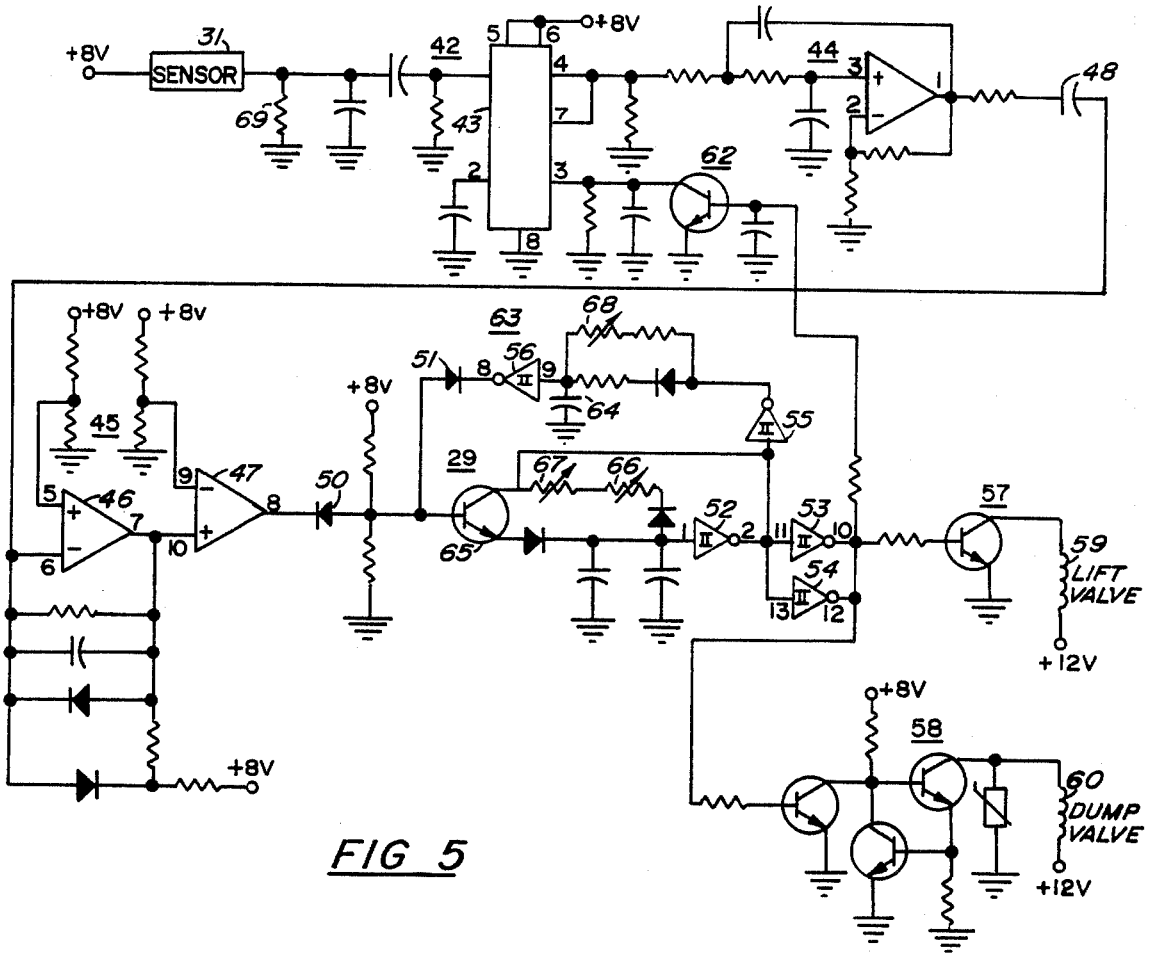
FIG. 5 is a schematic diagram of the electronic circuits of FIG. 4 connected between an accelerative sensor and hydraulic valves of the hydraulic system.

The block diagram of FIG. 4 and the schematic diagram of FIG. 5 show the new interconnections between conventional circuits for using signal input derived from the accelerative pickup 28 for operating a lift valve 40 and a dump valve 41 (FIG. 4). Since various conventional components can be used in the various stages to perform the required functions, the individual components of FIG. 5 are not described in detail. FIGS. 4 and 5 are described together with primary reference being made to FIG. 4.

The inductance of the pickup 28 is varied abruptly as the holes 30 of the sheave 25 pass adjacent to the pickup to interrupt the path of high permeability provided by the intermediate iron spokes. Each change in permeability causes the oscillator 31 either to start or to stop oscillation so as to develop pulses of oscillation, the series of pulses having a frequency proportional to the rate of rotation of the sheave 25. More particularly with reference to FIG. 5, an 8-volt supply line for supplying current to a sensor or oscillator 31 has a return path through a resistor 69 in the input circuit of accelerative signal circuits. The current flow through the supply circuit changes substantially as the oscillator 31 stops and starts oscillating to develop pulses of voltage across the resistor 69. The pulses of voltage developed across the resistor 69 are applied to an input of a converter 42 for changing the pulses to a d-c voltage that is proportional to the velocity of the hammer weight 22 (FIG. 1) as derived from the rotation of the sheave 25. With reference to FIG. 5, the circuits of the converter 42 may be a portion of an integrated circuit LM2907N-8. To smooth the pulses of d-c voltage, the output of the converter 42 is applied through an active filter 44 to an input of a differentiater 45.

As shown in FIG. 5, an amplifying circuit of the active filter 44 comprises an integrated circuit type 324 in conjunction with a resistive-capacitive circuit. Also, other circuits 46 and 47 of the integrated circuit type 324 are used for two successive stages of the differentiator 45. The output voltage from the active filter 44, the gain of the circuits, and the biases for setting the operating level of the circuits are chosen such that the output of the differentiator 45 is saturated in response to any substantial acceleration of the sheave 25. In FIG. 5, the capacitor 48 and the resistors to which it is connected are the main differentiating elements.

For simplicity, the output of the differentiator 45 is shown in the block diagram as being connected through an OR gate 49 for application to the input of the timer 29. In the schematic diagram shown in FIG. 5, the diode 50 corresponds to this input of the OR gate 49, and the diode 51 corresponds to the other input. The gain, signal voltage levels, and biases of the circuits 42, 44, and 45, that are conveniently called accelerative signal circuits, are chosen such that a binary output is derived from the differentiator 45 for controlling the timer 29. When any substantial acceleration of the sheave 25 is sensed by the pickup 28, the saturated voltage from the output of the differentiator 45 is one state for preventing timing by the timer 29, and when zero acceleration is sensed, the other state of the binary output is applied to the timer 29 for starting timing.

With respect to FIG. 5, the timer 29 comprises a type 2N2222 transistor 65 connected to charging capacitors and to series adjustable resistors 66 and 67. The resistor 66 is adjusted for calibration purposes, and the resistor 67 is controlled manually in the cab of the mobile hydraulic hammer for determining the length of stroke of the hammer weight 22 (FIG. 1). For control purposes, the output of the timer is connected through trigger circuits 52, 53, and 54 to transistor switching circuits for operating the lift valve 40 and the dump valve 41 shown in FIG. 4. The trigger circuits 52–56 are contained in an integrated circuit type CD40106B. Typical connecting pins are shown in the schematic diagram, pin 4 (not shown) is connected to plus 8 volts, and pins 5 and 7 are connected to ground. The amplifiers in the filter 44 and the differentiator 45 may be connected to pins as shown for type 324 integrated circuit, pin 4 (not shown) is connected to plus 12 volts, and pin 11 is connected to ground.

The output of the timer 29 controls the trigger circuits 52–54 for providing the proper voltage while the timer 29 is timing to make the transistor 57 conductive for energizing solenoid 59 coupled to the lift valve 40 (FIG. 4), and at the same time transistor 58 that is preceded by an inverting stage is non-conductive so that solenoid 60 coupled to the dump valve 41 is unenergized. Conversely, when the timer 29 is between timing periods, transistor 57 is non-conductive, and the transistor 58 is conductive for operating the dump valve 41. With reference to FIG. 4, the dump valve 41 is shown operated directly by the solenoid 60, and the lift valve 40 is shown operated by a spool valve 61 that is coupled to the solenoid 59.

To eliminate ambiguous readings derived from the accelerative pickup 28, a disabling circuit 62 and a delay circuit 63 are added to the main accelerative signal circuit. An output of the timer 29 is connected to an input of the disabling circuit 62, and the output of the disabling circuit is connected to a disabling input circuit of the converter 42. In FIG. 5, the disabling circuit 62 is shown as comprising a transistor having a collector circuit connected to pin 3 of the type LM2907N-8 integrated circuit for the converter 42. While the timer 29 is timing and the hammer is being lifted, voltage from the output of the timer through the disabling circuit 62 ensures that the converter 42 will apply to the differentiator 45 voltage of the required polarity to cause it to have an output corresponding to acceleration. After the timer 29 has reached the end of its timing period and the disabling circuit 61 is no longer effective to prevent application of the state corresponding to zero acceleration, the delay circuit 63 connected between the output and the input of the timer 29, becomes effective for a predetermined time to prevent application of the state corresponding to zero acceleration until, as explained above, downward acceleration of the hammer weight 22 (FIG. 1) is well established as shown below the point 37 on the velocity curve of FIG. 3. In FIG. 5, the delay circuits 63 includes the trigger circuits 55 and 56, a timing capacitor 64, and a variable resistor 68 for adjusting the length of delay.

Summairizing, when the timer 29 reaches the end of a timing period at a point 71 on the curve of FIG. 3, the cylinder 27 (FIG. 4) is dumped, and inertia of the hammer weight 22 (FIG. 1) causes the hammer weight 22 to rise a short distance until point 33 at which time the velocity is zero and the acceleration is nearly that of the acceleration of gravity. During the interval between the point 71 and a time a little later than that of point 33, the delay circuit 63 (FIG. 4) is effective to prolong the application of that binary output to the input of the timer 29 for preventing the start of timing. After downward accelerating is well established, the timer will respond to application of voltage to start timing, the disabling of the converter 42 by the disabling circuit 62 having been terminated at the end of the previous timing period.

Upon impact of the hammer weight 22 at point 34 of the curve, the timer is started. Presume that the impact at the point 34 is at a noticeably lower level that the level of impact of the previous stroke, the distance that the hammer weight 22 has fallen is somewhat longer than that desired. However, the succeeding downward travel between the points 37 and 39 of the curve will be automatically adjusted to the new level according to the starting time for that stroke, the length of stroke having been determined by the timing period between the points 34 and 38 of the curve. The result is that for a usual change of level, the length of only one stroke will depart from the desired length set for strokes on level surface. Ineffective short strokes or damaging long strokes are avoided, and wasted time between strokes is eliminated.

I claim:

1. In a mobile hydraulic hammer having a hammer weight, a system of sheaves and cables, said hammer weight being connected to said cable, a hydraulic cylinder connected to certain ones of said sheaves, hydraulic valve means connected to said hydraulic cylinder, operation of said hydraulic valve means to a first position filling said hydraulic cylinder to raise said hammer and to a second position dumping said hydraulic cylinder for permitting said hammer weight to drop, an electrical control system connected to said hydraulic valve means for controlling the operation thereof to determine the length of stroke of said hammer weight, the improvement comprising:

an accelerative sensor, said accelerative sensor being coupled to a particular one of said sheaves, switching means connecting said electrical control system to said hydraulic valve means for controlling the operation thereof, said electrical control system including a timer, said timer having an input starting circuit and an output circuit, said output circuit being connected to said switching means, accelerative signal circuits in said electrical control system having an input connected to said accelerative sensor and an output connected to said input starting circuit, said accelerative signal circuits in response to said sensor detecting acceleration of said particular one of said sheaves developing a disabling voltage for application to said input starting circuit of said timer to prevent restarting thereof, said accelerative signal circuits in response to said accelerative sensor detecting zero acceleration of said particular one of said sheaves when said hammer weight is in a lowest position applying a starting voltage to said input circuit of said timer to start said timer, said timer while timing maintaining said switching means in a first state for operating said hydraulic valve means to said first position thereof of to raise said hammer weight to a height according to a predetermined timing period of said timer, said timer at the end of said predetermined timing period operating said switching means to said second state to operate said hydraulic valve means to said second position thereof, and said timer maintaining said switching means in said second position until said accelerative sensor detects said zero acceleration when said hammer weight reaches a lowest position.

2. A mobile hydraulic hammer as claimed in claim 1 having disabling circuit means in said electrical control system, said disabling circuit means being connected between accelerative signal circuits and said timer to ensure application of said disabling voltage to said timer until acceleration of said particular one of said sheaves is positively established due to dropping of said hammer weight.

3. A mobile hydraulic hammer as claimed in claim 1 wherein said accelerative sensor is an electromagnetic proximity detector, said electromagnetic proximity detector being located at a position adjacent said particular sheave where the permeability thereof varies as said particular sheave is rotated.

4. A mobile hydraulic hammer as claimed in claim 3 wherein said accelerative sensor developes absolute value of output, a delay circuit connected between said output circuit and said input starting circuit of said timer, said delay circuit providing said disabling voltage to said input starting circuit for a predetermined time after said end of said predetermined timing period.

* * * * *